US006802127B2

(12) United States Patent
Thomaschewski

(10) Patent No.: US 6,802,127 B2
(45) Date of Patent: Oct. 12, 2004

(54) CUTTING KNIFE

(75) Inventor: Walter Thomaschewski, Filderstadt (DE)

(73) Assignee: C & E Fein GmbH & Co. KG (DE)

( * ) Notice: Subject to any disclaimer, the term of this patent is extended or adjusted under 35 U.S.C. 154(b) by 0 days.

(21) Appl. No.: 10/219,366

(22) Filed: Aug. 15, 2002

(65) Prior Publication Data

US 2003/0041462 A1 Mar. 6, 2003

Related U.S. Application Data

(63) Continuation of application No. PCT/EP01/01727, filed on Feb. 16, 2001.

(30) Foreign Application Priority Data

Feb. 25, 2000 (DE) ..... 200 03 499 U

(51) Int. Cl.[7] ..... B26B 9/02
(52) U.S. Cl. ..... 30/272.1; 30/277.4
(58) Field of Search ..... 30/277.4, 272.1, 30/294, 315, 353; 29/235, 239, 270; 7/100

(56) References Cited

U.S. PATENT DOCUMENTS

| | | | | | |
|---|---|---|---|---|---|
| 3,448,517 | A | * | 6/1969 | Cothery | 30/317 |
| 3,924,327 | A | * | 12/1975 | Edwards | 30/315 |
| 4,080,734 | A | * | 3/1978 | Barbour | 30/277 |
| 4,199,852 | A | | 4/1980 | Ayers et al. | 29/239 |
| 4,215,475 | A | * | 8/1980 | Morford et al. | 30/272.1 |
| 4,543,720 | A | | 10/1985 | Grunikiewicz et al. | 30/272 R |
| 4,700,478 | A | * | 10/1987 | Mezger et al. | 29/239 |
| 4,852,261 | A | * | 8/1989 | Wittek | 30/277.4 |
| 4,980,976 | A | * | 1/1991 | Junginger et al. | 30/277.4 |
| 5,038,478 | A | * | 8/1991 | Mezger et al. | 30/272.1 |
| 5,231,910 | A | * | 8/1993 | Harsch et al. | 30/277.4 |
| 5,784,788 | A | * | 7/1998 | Cothery | 30/294 |
| 5,826,342 | A | * | 10/1998 | Zuro | 30/294 |
| 6,401,342 | B1 | * | 6/2002 | Kloss et al. | 30/272.1 |
| 6,434,835 | B1 | * | 8/2002 | Grunikiewicz et al. | 30/272.1 |
| 6,442,844 | B1 | * | 9/2002 | Grunikiewicz et al. | 30/272.1 |

FOREIGN PATENT DOCUMENTS

| | | | |
|---|---|---|---|
| EP | 294617 | * | 5/1988 |
| EP | 1068937 | * | 5/2000 |

* cited by examiner

*Primary Examiner*—Stephen Choi
(74) *Attorney, Agent, or Firm*—St. Onge Steward Johnston & Reens LLC

(57) ABSTRACT

A cutting knife for a cutting tool for cutting through adhesive beads on glass panes of vehicles comprises an attachment part and a cutting part. The attachment part, on a first end thereof, is provided with a receiving opening for attachment to an oscillating drive and taperes toward a second end. The cutting part extends at an angle with respect to a plane in which the flat attachment part extends. The cutting part has two lateral edges that join each other at the outer end of the cutting part, at least one of the lateral edges of the cutting part being shaped as a corrugated or serrated cutting edge.

10 Claims, 1 Drawing Sheet

CUTTING KNIFE

This application is a continuation of pending International Application No. PCT/EP01/01727 filed Feb. 16, 2001, which designates the United States and claims priority from pending German Application No. 200 03 499 filed Feb. 25, 2000.

BACKGROUND OF THE INVENTION

The present invention relates to a cutting knife for a cutting tool for cutting through adhesive beads on glass panes of vehicles, having an attachment part and a cutting part, the attachment part being provided, on a first end, with a receiving opening for attachment to an oscillating drive adapted to drive the cutting knife in oscillating fashion about an axis that extends perpendicularly to the receiving opening, and tapering toward a second end, with the cutting part and the attachment part extending at a right angle one relative to the other.

Cutting knives that are used in connection with an oscillating drive to cut out glass panes from vehicles are known.

U.S. Pat. No. 4,543,720 to Grunikiewicz et al. describes, for example, a cutting knife with U-shaped cross-section which comprises an attachment part for attachment to an oscillating drive adapted to drive the cutting knife in oscillating fashion about an axis that extends perpendicularly to the attachment opening, and further a cutting part, curved in sickle shape, that is connected with the attachment part through a cross bar.

As the cutting knife is driven by the oscillating drive, it is set into high-frequency rotary oscillation so that the adhesive bead can be cut through by sort of a scythe effect.

The cutting knife is introduced for this purpose from the outside through the gap between the pane and the body flange, the adhesive bead is pierced and/or the cutting knife is introduced through a recess in the adhesive bead, whereafter the oscillating drive is switched on and the adhesive bead is cut through gradually.

A cutting knife with L-shaped cross-section is known from U.S. Pat. No. 4,199,852 to Ayers et al. Contrary to the afore-mentioned cutting knife, that cutting knife instead of being set into rotary oscillation by a rotary oscillating drive, is set into percussion movement by a longitudinally oscillating drive, by which the cutting part, that projects at an angle from the attachment part, is set into oscillating movement perpendicular to the attachment part. A guide roller is provided in this case as support against the glass pane.

It has been found that cutting knives of that kind with L-shaped cross-section are particularly well-suited in certain applications, especially under spatially constrained conditions, for example for detaching a windshield from a motor vehicle. However, the percussion movement presents an especially high risk that the windshield or the vehicle paint may be damaged during that operation.

SUMMARY OF THE INVENTION

Therefore, it is a first object of the present invention to provide an improved cutting knife for cutting through adhesive beads on glass panes of vehicles, by means of which glass panes can be cut out even under unfavorable conditions from outside the vehicle.

It is a second object of the invention to provide a cutting knife allowing an untiring working when cutting through an adhesive bead of a vehicle plass pane.

It is a third object of the invention to provide a cutting knife having a long service life.

It is a further object of the invention to provide a cutting knife that reduces the risk of damage to the glass pane and the vehicle paint when cutting through an adhesive bead of a vehicle plass pane.

These and other objects of the invention are achieved by a cutting knife for a cutting tool for cutting through adhesive beads on glass panes of vehicles, having an attachment part and a cutting part, the attachment part being provided, on a first end, with a receiving opening for attachment to an oscillating drive adapted to drive the cutting knife in oscillating fashion about an axis that extends perpendicularly to the receiving opening, and tapering toward a second end, the cutting part and the attachment part being commonly produced from a flat blank and the cutting part projecting from the second end of the attachment part at an angle to the latter, the cutting part having two lateral edges that join each other at the outer end of the cutting part, and at least one of the lateral edges of the cutting part being shaped as a cutting edge with corrugated or serrated edge.

Due to its L-shaped cross-section, the cutting knife according to the present invention permits glass panes to be cut out from outside the vehicle, and this even under geometrically relatively unfavorable conditions. Due to the fact that the oscillating drive sets the cutting part into oscillating movement so that the cutting part moves to and fro in the cutting direction, perpendicularly to its cutting edge, the drive power of the oscillating drive as such is utilized for cutting through the adhesive bead. The corrugation or serration on at least one cutting edge permits improved penetration of the cutting edge into the adhesive bead so that improved cutting efficiency can be achieved with a lesser amount of force applied. At the same time, the risk of breakage is reduced.

According to an advantageous further improvement of the invention, the second lateral edge of the cutting part is configured as a straight cutting edge.

The additional cutting edge, opposite the side of the cutting part with the corrugated or serrated edge, enhances the cutting effect during the forward stroke of the cutting part and simultaneously permits the cutting part to be retracted through an adhesive bead already cut through, if this should become necessary, for example if a new start is desired during the cutting operation.

According to a further embodiment of the invention, both sides of the cutting part are sharpened from both sides so that a bulged cross-section is obtained.

This results in an especially favorable geometry of the two cutting edges and in improved cutting efficiency.

According to a further development of the invention, the attachment part is sharpened in the transition area to the cutting part along at least one lateral edge, although it is preferred to have both sides sharpened, and groove-like recesses are formed that taper off toward the lateral edges.

Such an embodiment results in an especially favorable cutting effect, especially in the transition area between the cutting part and the attachment part, whereby the risk of breakage of the cutting knife is clearly reduced and the cutting operation generally requires the application of less force.

In addition, the fact that the cutting part is sharpened on both sides in the transition area and that groove-like recesses are formed between the cutting part and the flat remaining portion of the attachment part results in improved guidance of the cutting knife during the cutting operation.

According to a further preferred development of the invention, the two cutting edges of the cutting part join each other at the end in the form of a rounded tip.

This facilitates the process of introducing the tool into the adhesive bead at the beginning of the cutting-out operation.

Further, the attachment part and the cutting part preferably extend substantially at a right angle one relative to the other.

It is understood that the features of the invention mentioned above and those yet to be explained below can be used not only in the respective combinations indicated, but also in other combinations or in isolation, without leaving the scope of the present invention.

BRIEF DESCRIPTION OF THE DRAWINGS

Further features and advantages of the invention are evident from the description below of preferred exemplary embodiments. In the drawings.

DETAILED DESCRIPTION OF THE PREFERRED EMBODIMENTS

Figure 1:
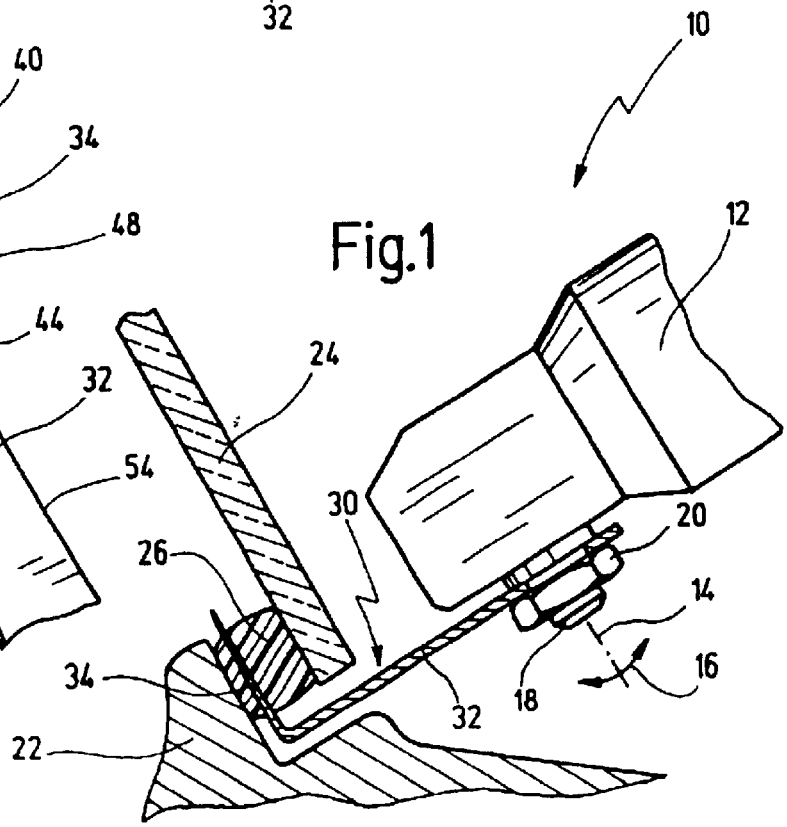
FIG. 1 shows a sectioned representation of a cutting knife according to the present invention, being used with an oscillating drive.

Referring to FIG. 1, a cutting tool according to the invention is generally indicated by reference numeral 10.

Figure 2:
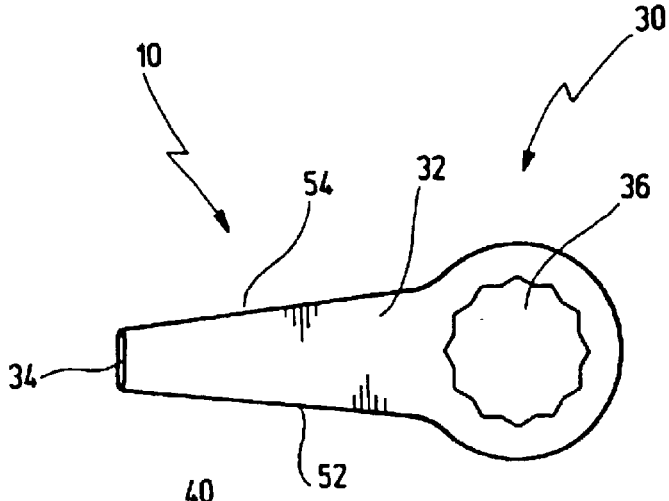
FIG. 2 shows a top view of the cutting knife according to FIG. 1, viewed from above.

The cutting tool 10 comprises an oscillating drive 12 whose drive shaft 18 can be driven in oscillating fashion at high frequency in the range of approximately 5000 to 25000 oscillations per minute and with a small pivot angle in the range of between approximately 0.5° to 5°. On the drive shaft 18, a cutting knife indicated generally by reference numeral 30 is positively received with a receiving opening (FIG. 2) on a polygonal member of the drive shaft 18 and is secured by way of a nut 20 on a thread of the drive shaft 18.

Figure 3:
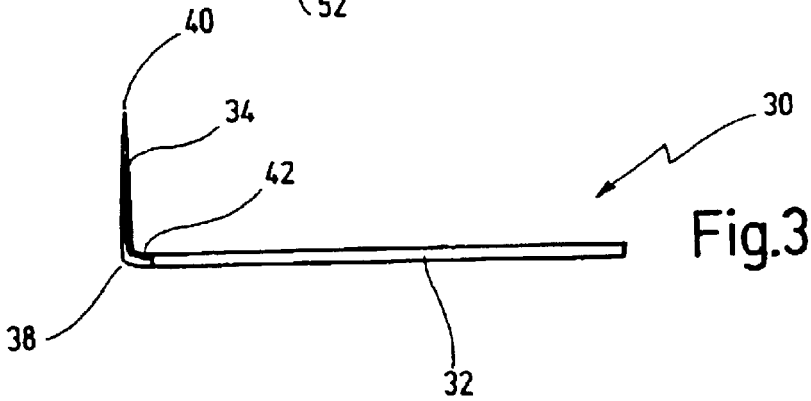
FIG. 3 shows a side view of the cutting knife according to FIG. 2.

As can be seen in FIG. 3, the cutting knife 30, with its attachment part 32 and its cutting part 34 that projects substantially at a right angle from the attachment part 32, exhibits an L-shaped cross-section.

The cutting part 34 comprises a first cutting edge 46 with a corrugated edge, and on its opposite side a second cutting edge 48 with a serrated edge, and the two cutting edges 46, 48 join each other at the outer end of the cutting part 34 in the form of a rounded tip 40.

The cutting tool serves for cutting through an adhesive bead 26 of a glass pane 24 that is adhesively bonded onto a body flange 22 of a motor vehicle. The glass pane may be a windshield, for example, that is joined and/or adhesively bonded in completely sealing fashion on the A-pillar of the body by way of the surrounding adhesive bead 26. This adhesive bead 26 is usually made of a special polyurethane which exhibits the highest possible UV resistance and a high level of mechanical and long-term stability. As a result of this adhesive bonding of the windshield to the A-pillar, the windshield contributes substantially to the stability of the body. It is therefore understood that the adhesive bead is made of a material that is so tough and stable that completely cutting through it in order to remove the windshield, for example after stone impact damage, requires the application of a considerable amount of force, even when the advantageous effect of the oscillating drive 12 is taken into account.

For this reason, numerous cutting knife variants, that have been explained above, have already been developed.

The cutting knife according to the present invention facilitates the operation of cutting through an adhesive bead due to the fact that the cutting edge 46 is provided with a corrugated edge or a serrated edge.

The cutting knife 10 is made, preferably punched, from a flat blank which is bent in a suitable way so that the L-shaped cross-section shown in FIG. 3 is obtained. The cutting tool 30 is made of a suitable, preferably hardened, knife steel.

The attachment part 32 comprises two lateral edges 52, 54 that enclose the receiving opening 36, formed as a polygonal element, and that taper in substantially wedge-like fashion toward the cutting part 34. In its transition area to the cutting part 34, i.e. the area preceding the bent portion, which forms the transition from the attachment part 32 to the cutting part 34, the attachment part 32 is sharpened from both sides in the area of the lateral edge 52 and the area of the lateral edge 54 so that both lateral edges 52, 54 are configured as straight cutting edges in the transition area to the cutting part 34.

Figure 4:
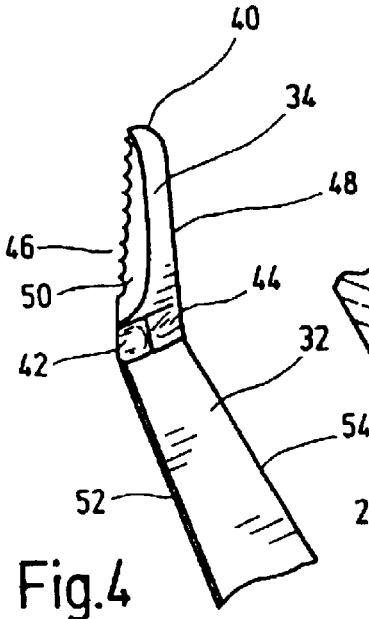
FIG. 4 shows a perspective view of a detail of the cutting knife, viewed a little laterally from the attachment part toward the cutting part.

As can be seen in FIG. 4, the fact that the cutting tool 10 is sharpened in the area of the inside of the bend gives rise to the formation of groove-like recesses 42, 44 that taper off from the center toward the lateral edges 52, 54.

The transition area is thus provided with cutting edges on both sides in the area of the bend, while the groove-like recesses 42, 44 have an additional centering effect on the inside of the bend that provides a supporting guiding function when cutting through the adhesive bead 26.

The cutting part 34 as such is sharpened on both cutting edges 46, 48, preferably from both sides, so that a bulged cross-section of the cutting part is obtained, and additionally the corrugation is provided on the cutting edge 46 in the area of a sharpened portion 50 of the cutting part 34 on the inside of the bend, which tapers off toward the outside.

What is claimed is:

1. A cutting knife for a cutting tool for cutting through adhesive beads on glass panes of vehicles, said cutting knife comprising:

an attachment part having a first end and tapering toward a second end;

a cutting part being integral with said attachment part from a flat blank and projecting from said second end of said attachment part at an angle with respect to a plane defined by said attachment part;

a receiving opening provided on said first end of said attachment part for attaching said cutting knife to an oscillating drive for oscillatingly driving said cutting knife about an axis extending perpendicularly to said receiving opening;

two lateral edges provided on said cutting part and joining each other at an outer end of said cutting part, at least one of said lateral edges being shaped as a serrated cutting edge;

wherein said attachment part merges into said cutting part at a transition area that is sharpened along at least one lateral edge; and wherein said transition area is sharpened along said lateral edges of said transition area, the transition area comprising groove-like recesses tapering off toward said lateral edges of said transition area.

2. The cutting knife as defined in claim 1, wherein another one of said two lateral edges is configured as a straight cutting edge.

3. The cutting edge as defined in claim 1, wherein both lateral edges of said cutting part are sharpened from both sides, so that the cutting part has a bulged cross-section.

4. The cutting knife as defined in claim 1, wherein both lateral edges of said cutting part are configured as cutting edges joining each other at an outer end of said cutting part forming a rounded tip thereby.

5. The cutting knife as defined in claim 1, wherein said attachment part and said cutting part extend substantially at a right angle one relative to the other.

6. A cutting knife for a cutting tool for cutting through adhesive beads on glass panes of vehicles, said cutting knife comprising:

a flat attachment part extending in a plane, said attachment part having a first end and tapering toward a second end;

a receiving opening provided on said first end of said attachment part for attaching said cutting knife to an oscillating drive for oscillatingly driving said cutting knife about an axis extending perpendicularly to said receiving opening;

a cutting part being integral with said attachment part and projecting from said second end of said attachment part at an angle with respect to said plane defined by said attachment part;

two lateral edges provided on said cutting part and joining each other at an outer end of said cutting part, at least one of said lateral edges being shaped as a corrugated cutting edge;

wherein said attachment part merges into said cutting part at a transition area that is sharpened along at least one of said lateral edges;

wherein said transition area is sharpened along said lateral edges of said transition area, the transition area comprising groove-like recesses tapering off toward said lateral edges of said transition area.

7. The cutting knife as defined in claim 6, wherein another one of said two lateral edges is configured as a straight cutting edge.

8. The cutting knife as defined in claim 6, wherein both lateral edges of said cutting part are sharpened from both sides, so that the cutting part has a bulged cross-section.

9. The cutting knife as defined in claim 6, wherein both lateral edges of said cutting part are configured as cutting edges joining each other at an outer end of said cutting part forming a rounded tip thereby.

10. The cutting knife as defined in claim 6, wherein said attachment part and said cutting part extend substantially at a right angle one relating to the other.

* * * * *